United States Patent [19]

Kim

[11] Patent Number: 4,776,427

[45] Date of Patent: Oct. 11, 1988

[54] ECHO SOUNDS MELODEON

[76] Inventor: Ki D. Kim, 355-184, Shingil 3-dong, Youngdungpo-gu, Seoul, Rep. of Korea

[21] Appl. No.: 65,460

[22] Filed: Jun. 23, 1987

[51] Int. Cl.[4] ..... G10K 11/00

[52] U.S. Cl. ..... 181/175; 181/141

[58] Field of Search ..... 181/18, 19, 22, 175, 181/141; 84/355-357

[56] References Cited

U.S. PATENT DOCUMENTS 2,849,909 9/1958 Gobbi ..... 84/355

FOREIGN PATENT DOCUMENTS 0219336 2/1910 Fed. Rep. of Germany ..... 84/355

0532379 1/1941 United Kingdom ..... 84/355

*Primary Examiner*—B. R. Fuller

*Attorney, Agent, or Firm*—Paul J. Winters; Alan H. MacPherson; Richard Franklin

[57] ABSTRACT

An echo sound melodeon, in accordance with the principles of this invention, includes a body on which is mounted a keyboard and a holder, and a controlled flow of air into an interior of the body. A propeller is placed in the interior of the body in the path of the controlled flow of air. The spinning of the propeller causes the flow of air to vibrate and the vibrating air creates echo sound effects.

5 Claims, 2 Drawing Sheets

ECHO SOUNDS MELODEON

BACKGROUND OF THE INVENTION

Existing melodeons are played by using a mouth-blower. So, these existing melodeons have often caused problems, such as the damage to human's respiratory organ and corrosion of the instrument's sound device by spittle or breath.

Therefore, the existing melodeons often have a low sound quality and a low quality of performance because of the corrosion.

Further, existing melodeons cannot make echo sounds, consequently, their sounds looked too simple.

This invention was particularly aimed at creating echo sounds by connecting a separate air injection pedal to the body of the melodeon for air injection.

This invention frees the players from the above problems. Also, from sanitary point of view, this invention is desirable because there is no possibility of players catching diseases by using the mouth-blower.

SUMMARY OF THE INVENTION

The present invention makes echo sounds by using a propeller in the air guide pipe, a air cylinder and a separately-installed air injection pedal.

The invention makes it easier to play the melodeon because the air injection pedal, if repeatly pressed by foot, injects air into the body of instrument through the air cylinder.

The air, injected by the air pedal, puts into motion a propeller in the air guide pipe, creating echo sounds.

The echo sounds are made only when the center of the air guide pipe is aligned with the center of the inlet tube which is connected with the air hose and the air cylinder.

The present invention will be better understood by those skilled in the art from a reading of the following detailed description in conjunction with the accompanying drawings which show the devices of the invention for illustration purpose only, but not for limiting the scope thereof in any way.

DESCRIPTION OF THE PREFERRED EMBODIMENTS

Figure 1:
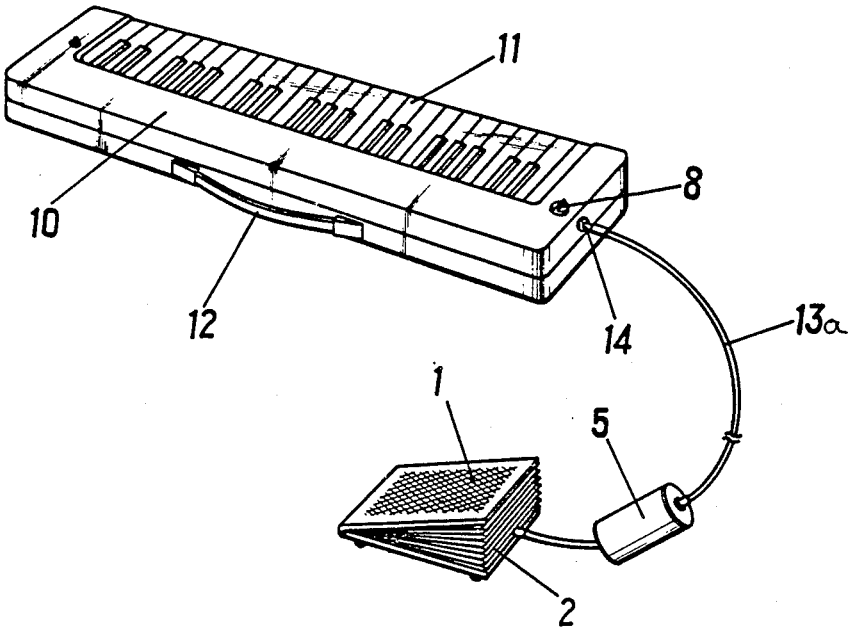
FIG. 1 is a perspective view of an embodiment of the echo sounds melodeon according to the present invention.

Refering to FIG. 1, the echo sounds melodeon(10) is shown, having a key board(11) and a holder(12). The side of melodeon(10) has a control knob(8) and an inlet tube(14). The inlet tube(14) is connected to one end of a first air hose(13*a*). The other end of the first air hose(13*a*) is connected to the air cylinder(5). A second air hose(13*b*) connects the air cylinder(5) with the air injection pedal(1).

The pedal(1), if repeatly pressed by foot, injects air into the body of the melodeon(10) through the cylinder(5), the air hose(13*a*) and the air inlet tube(14).

Figure 2:
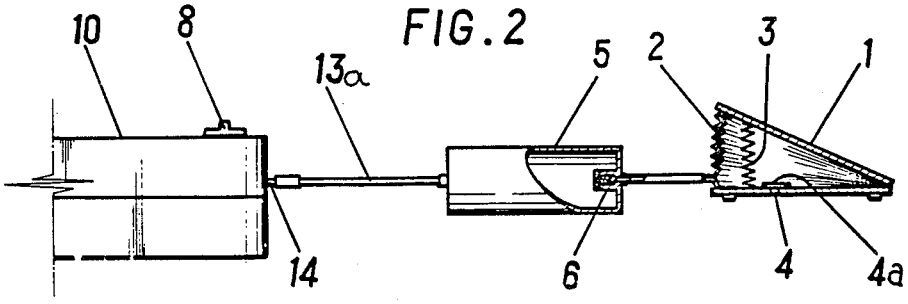
FIG. 2 is a partial side view of the present invention, partially in a section view.

As shown in FIG. 2, the pedal(1) has a bellows(2), air hole(4), and floator(4*a*) cover the air hole(4) for air suction and injection.

After the pedal(1) is depressed, the angle of the air injection pedal(1) is changed by the spring(3) and the bellows(2).

The movement of the air injection pedal(1) caused by action of the spring (3), draw air into the bellows(2) from outside through the air hole(4), and then the air goes into the air cylinder(5) when the pedal(1) is again depressed.

When the air injection padal(1) is pressed by foot, air moves to the air cylinder(5) from the bellows(2) with the floator(4*a*) being closed as shown FIG. 2.

On the other hand, when the air injection pedal(1) is no longer pressed, a described above air moves from outside into the bellows(2) through the air hole(4) with the floater(4*a*) being opened.

Figure 3:
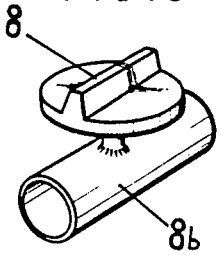
FIG. 3 is a perspective view of the control knob with air guide pipe from FIG. 1.
Figure 4:
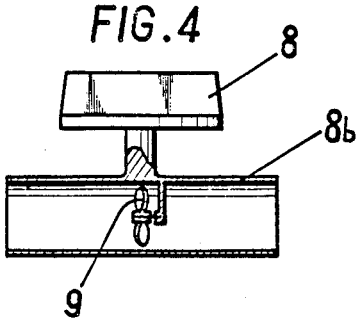
FIG. 4 is a side view of FIG. 3, partially in a section view.

As shown in FIG. 3 and FIG. 4, control knob(8) is placed on top of the air guide pipe(8*b*) which contains an air propeller(9). This air propeller(9) is moved by the passing air flow in the air guide pipe(8*b*).

Figure 5:
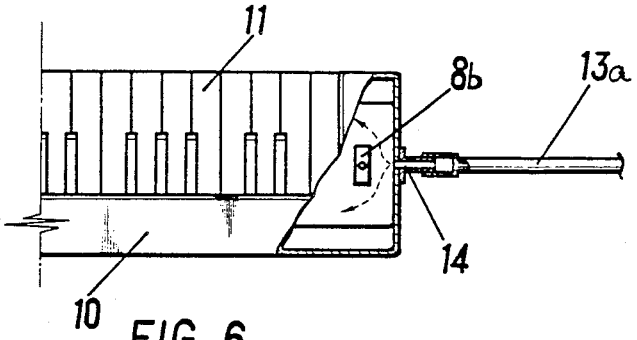
FIG. 5 is a plan view showing the normal position of the air guide pipe according to the present invention.
Figure 6:
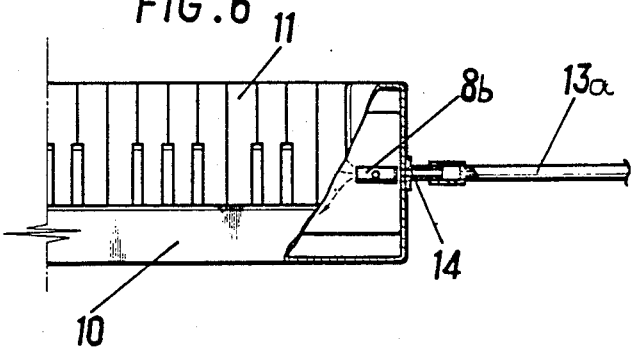
FIG. 6 is a plan view showing the echo sound position of the air guide pipe according to the present invention.

FIG. 5 and FIG. 6 show how to control the making of the echo sounds; FIG. 5 illustrates the position of the air guide pipe (8*b*) so that the instrument makes normal sounds, and FIG. 6 shows the position of the air guide pipe(8*b*) so that the invention makes echo sounds.

When the air guide pipe(8*b*) is in a vertical position, as in FIG. 5, air can not pass through this air guide pipe(8*b*) from the inlet tube(14) and echo sounds are not created.

When the air guide pipe(8*b*) is in the horizontal position, as in FIG. 6, air passes through the air guide pipe(8*b*), moving the air propeller(9), as shown in FIG. 4.

The movement of the, air propeller(9), as shown in FIG. 6 vibrates the air in the body while playing the melodeon. Normal sounds are changed into echo sounds by the air vibration.

Figure 7:
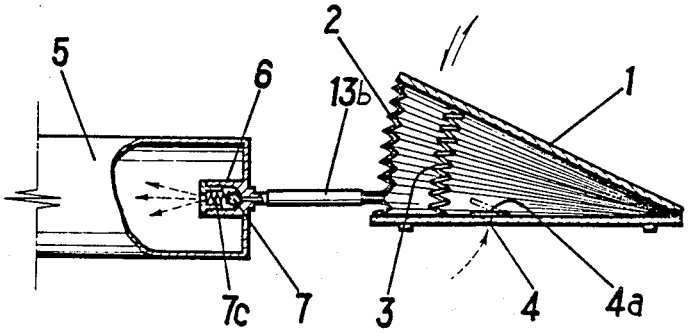
FIG. 7 is a section view of air injection utilizing the cylinder and pedal of the present invention.

FIG. 7 shows an enlarged drawing of FIG. 2 for air injection flow. In the device shown, the air cylinder(5) has a one-way valve(6), comprised of a composed spring(7*c*) and a steel ball (7), for air filling. The function of the one-way valve(6) is to control air flow inside the air cylinder(5), making it possible to create sounds.

From the above description, it will be understood that the invention provides an echo sounds melodeon by using a device such as a propeller in the air guide pipe, an air cylinder and an air injection pedal.

What is claimed is:

1. An echo sound melodeon having a body, a keyboard operatively mounted on said body, and an air inlet tube having a first end and a second end wherein said air inlet tube is mounted to said body so that said first end is exterior to said body and said second end communicates with an interior of said body, and a holder mounted on an exterior surface of said body and further comprising:

means for providing a controlled flow of air;

means for coupling said means for providing a controlled flow of air to said first end of said air inlet tube so that said controlled flow of air passes into said body interior through said air inlet tube; and means operatively mounted to said body for selectively causing said controlled flow of air to vibrate within said body interior and cause echo sound effects.

2. An echo sound melodeon as in claim 1 wherein said means for providing a controlled flow of air comprises:

an air cylinder having an inlet tube, an outlet tube and a one-way valve wherein said valve is contained within said air cylinder and said valve is connected to said inlet tube of said air cylinder and further wherein said means for coupling is attached to said outlet tube.

an air hose and an air injection pedal wherein said air hose connects said air injection pedal to said inlet tube of said air cylinder.

3. An echo sound melodeon as in claim 2 wherein said one-way valve contained in said air cylinder comprises a steel ball and a spring arranged so as to permit air flow through said inlet tube of said air cylinder into the air cylinder and to prevent air flow from said air cylinder back into said inlet tube of said air cylinder.

4. An echo sound melodeon as in claim 2 wherein said air injection pedal comprises a bellows, a first solid plate having a hole, a floater valve covering said hole, a second solid plate pivotally connected on one side to said first solid plate, and a spring wherein said bellows are attached between and to said solid plates so as to form an airtight compartment, and said spring is contained within said bellows and between said plates.

5. An echo sound melodeon as in claim 1 wherein said means for selectively causing said controlled flow of air to vibrate within said body and cause echo sound effects comprises a knob, a cylindrical pipe, and a propeller, wherein said knob is firmly attached to an outside surface of said cylindrical pipe; said knob is operatively mounted exterior to said body; said cylindrical pipe is operatively mounted interior to said body; and said propeller is attached to and inside said cylindrical pipe so that said controlled flow of air is caused to vibrate only when said cylindrical pipe is aligned with said air inlet tube so that said controlled flow of air passing through said air inlet tube causes said propeller to spin.

* * * * *